US005598982A

United States Patent [19]

Betts et al.

[11] Patent Number: 5,598,982

[45] Date of Patent: Feb. 4, 1997

[54] CANTILEVERED SWING JAW CRUSHING APPARATUS

[75] Inventors: Edmund W. Betts, Taffs Well; Wayne Elliott, Treorchy; Teddy B. James, Pontypridd, all of United Kingdom

[73] Assignee: Brown Lenox & Co. Limited, United Kingdom

[21] Appl. No.: 500,930

[22] PCT Filed: Jan. 26, 1994

[86] PCT No.: PCT/GB94/00147

§ 371 Date: Sep. 11, 1995

§ 102(e) Date: Sep. 11, 1995

[87] PCT Pub. No.: WO94/17912

PCT Pub. Date: Aug. 18, 1994

[30] Foreign Application Priority Data

Feb. 1, 1993 [GB] United Kingdom ..... 9301955

[51] Int. Cl.[6] ..... B02C 1/04

[52] U.S. Cl. ..... 241/264; 241/268

[58] Field of Search ..... 241/264, 265, 241/268

[56] References Cited

U.S. PATENT DOCUMENTS

| | | | |
|---|---|---|---|
| 4,398,674 | 8/1983 | Dremann | 241/30 |
| 4,512,524 | 4/1985 | Shigemizu | 241/101.7 |
| 4,989,797 | 2/1991 | DeDiemar et al. | 241/264 |

FOREIGN PATENT DOCUMENTS

| | | |
|---|---|---|
| 853080 | 11/1960 | United Kingdom . |
| 968557 | 9/1964 | United Kingdom . |
| 970754 | 9/1964 | United Kingdom . |
| 1027520 | 4/1966 | United Kingdom . |
| 1224573 | 3/1971 | United Kingdom . |
| 1602489 | 11/1981 | United Kingdom . |
| WO89/04718 | 6/1989 | WIPO . |

*Primary Examiner*—John M. Husar

*Attorney, Agent, or Firm*—Greenlee, Winner and Sullivan P.C.

[57] ABSTRACT

Provided herein is a cantilevered swing jaw crushing apparatus comprising a main frame, two jaws mounted on the main frame for crushing material passing through the apparatus, means for driving the jaws in a crushing action and a bearing support, wherein the cantilevered swing jaw comprises an upper portion pivotally attached to the main frame and a lower portion for cooperating with the second jaw of the apparatus, an elbow being formed between the upper portion and the lower portion and wherein the bearing support is mounted on the main frame and bears against the elbow of the cantilevered swing jaw to support the swing jaw throughout the motion of the jaw. In a crushing apparatus according to the invention, forces applied to the cantilevered swing jaw are transferred via the bearing support to the main frame rather than to the pivot axis of the swing jaw.

12 Claims, 4 Drawing Sheets

CANTILEVERED SWING JAW CRUSHING APPARATUS

FIELD OF THE INVENTION

This invention relates to cantilevered swing jaw crushing apparatus, and in particular to means for reducing the forces acting on the mounting points of the cantilevered swing jaw.

BACKGROUND OF THE INVENTION

Apparatus for crushing rocks and other materials are well known. Many crushing apparatus incorporate a stationary jaw and a swing jaw which move towards and away from each other during use to crush rocks therebetween. The swing jaw may be straight, as in the well known "Blake" type crushers (cf. GB-853080), or cantilevered as in the crusher disclosed in GB-2232095, for example.

The manner in which the various types of crushing apparatus function varies considerably depending upon whether the swing jaw is straight or cantilevered. The present invention relates solely to the cantilevered type swing jaw crushing apparatus.

WO 89/04718 (GB-2232095) discloses a cantilevered swing jaw crushing apparatus comprising a main frame, a stationary law, a cantilevered swing jaw mounted about a top pivot axis and means for driving the swing jaw. The apparatus further includes a vertical impact plate mounted on the main frame for protecting the swing jaw from rocks entering the crushing apparatus through the feed opening. The rocks strike the impact plate which absorbs the energy associated therewith. Although such an impact plate is useful in a crushing apparatus, because it reduces the forces applied to the mounting hinge of the swing jaw, the arrangement is not ideal and the present invention aims to improve upon it.

SUMMARY OF THE INVENTION

The present invention provides a cantilevered swing jaw crushing apparatus comprising a main frame, two jaws mounted on the main frame for crushing material passing through the apparatus and means for driving the jaws in a crushing action, wherein the cantilevered swing jaw comprises an upper portion pivotally attached to the main frame and a lower portion for cooperating with the second jaw of the apparatus, the upper and lower portions defining an elbow, characterised in that the cantilevered swing jaw is mounted on the main frame by means of two short stub axles extending inwardly from the main frame, and in that a bearing support is mounted on the main frame and bears against the rear of the elbow of the cantilevered swing jaw to support the swing jaw throughout the motion of the jaw such that at least some forces exerted on the swing jaw are transferred to the main frame rather than to the stub axles mounting the swing jaw.

By including the bearing support, the mounting of the swing jaw does not bear the full force exerted on the swing jaw when rocks or the like are entered into the crushing apparatus.

In one embodiment, the bearing support includes an arcuate surface which contacts the swing jaw throughout the motion of the jaw. Of course, the bearing support may, alternatively, include a plurality of arcuate surfaces spaced across the width of the swing jaw.

The arcuate surface is preferably self-lubricating. In this regard, the arcuate surface may be coated in polytetrafluoroethylene (PTFE) or may be formed of nylon or some other appropriate material.

If the bearing support includes an arcuate surface, one or more shim is preferably provided between the arcuate surface and the main frame. The or each shim helps to prevent excessive wear between the bearing support and the main frame.

In an alternative embodiment, the bearing support may include a roller, the surface of which contacts the swing jaw throughout the motion of the jaw.

A single roller may extend across the complete width of the crushing apparatus. Alternatively, a plurality of rollers spaced across the width of the crushing apparatus, or a pair of rollers supporting either side of the swing jaw, could equally well be used.

The or each roller may be made of steel or any other appropriate material. If steel is used, the roller is preferably made of rolled steel.

Irrespective of which specific embodiment of bearing support is used, the bearing support is preferably enclosed by the main frame and one or more flexible seal attached to the swing jaw. By enclosing the bearing support, the bearing support does not become contaminated with dust and debris, which would cause the contact between the bearing support and the swing jaw to deteriorate.

The second jaw of the crushing apparatus is preferably a stationary jaw fixed to the main frame. In theory, however, a second swing jaw could be used without detracting from the present invention.

In a preferred embodiment, the main frame widens adjacent the stub axles so that the stub axles do not obstruct a top feed opening of the crushing apparatus.

BRIEF DESCRIPTION OF THE DRAWINGS

Specific embodiments of the present invention are now described, by way of example only, with reference to the accompanying drawings, in which.

DESCRIPTION OF THE PREFERRED EMBODIMENTS

Figure 1:
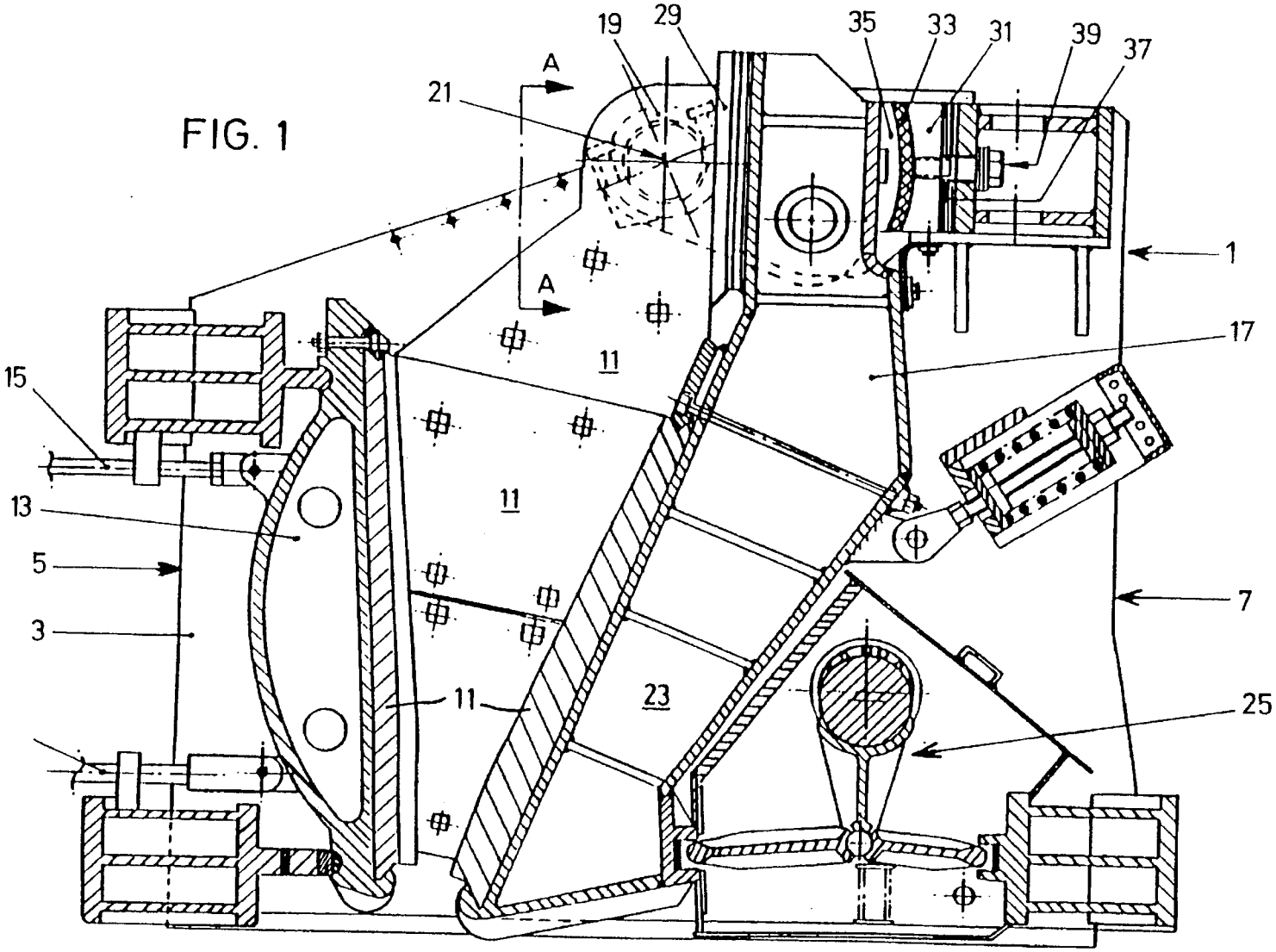
FIG. 1 is a cross-sectional side view of a cantilevered swing jaw crushing apparatus according to a first embodiment of the present invention.
Figure 2:
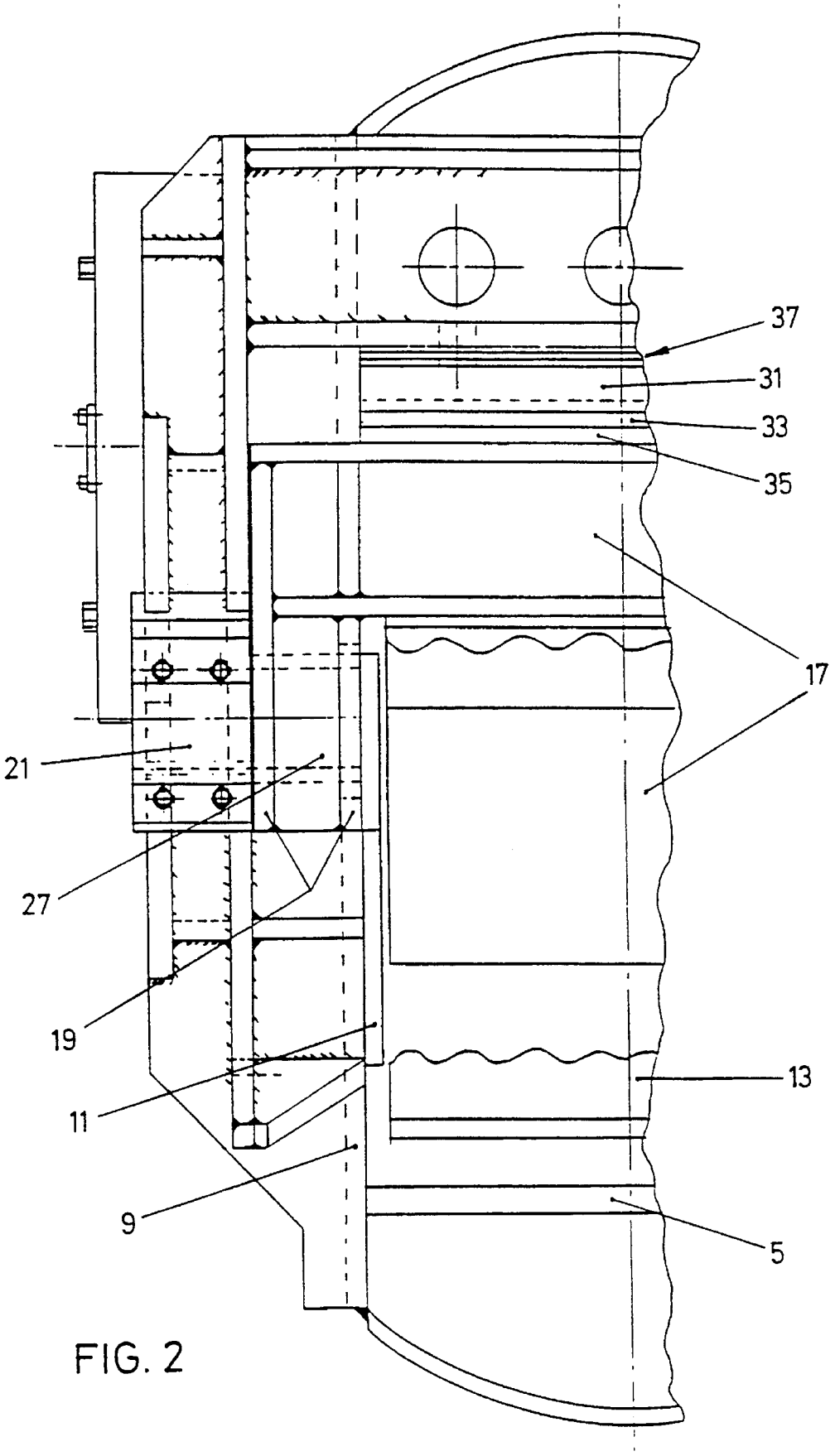
FIG. 2 is a partial plan view of one side of the crushing apparatus shown in FIG. 1.
Figure 3:
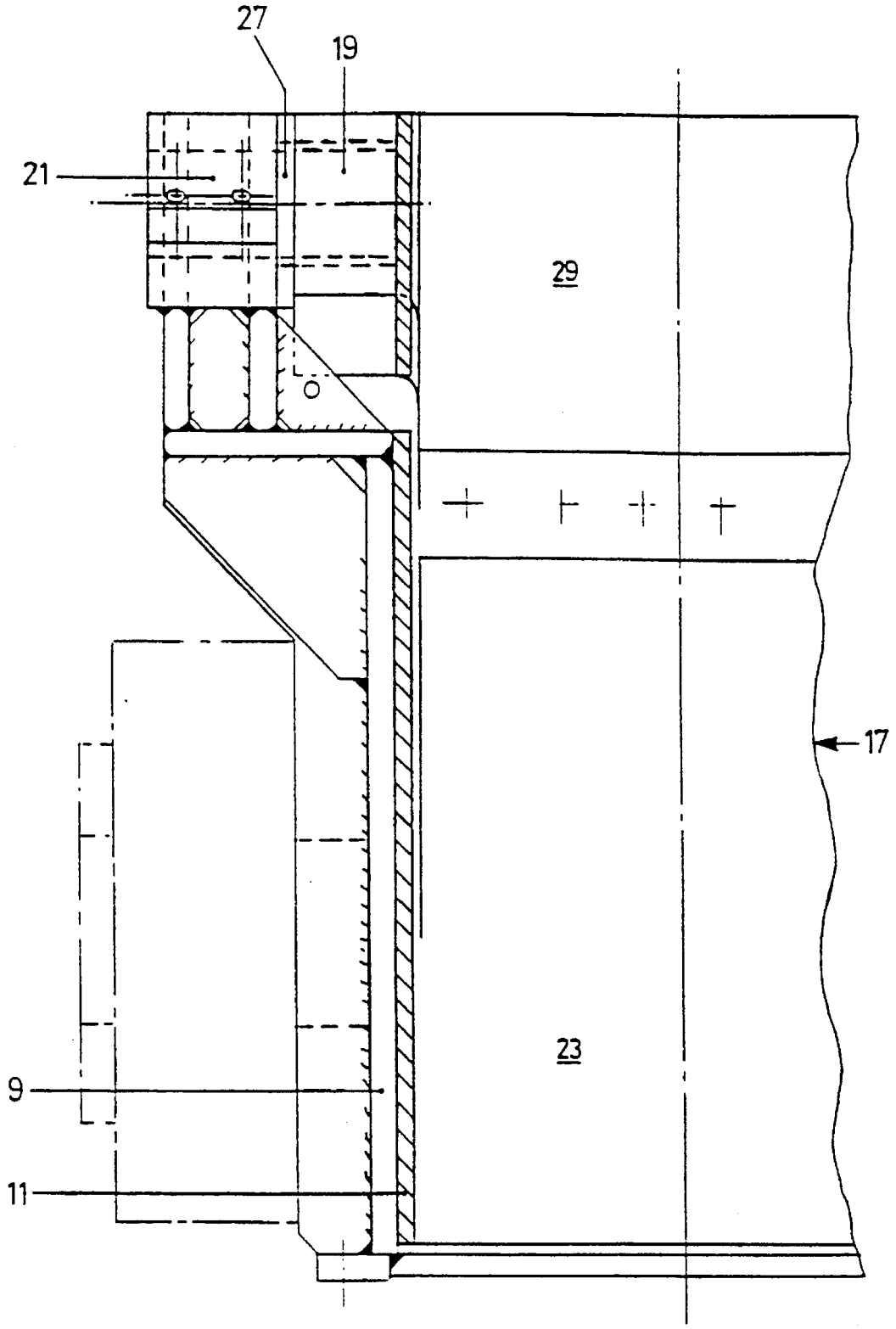
FIG. 3 is a partial front view in the direction A—A of FIG. 1.

With reference to FIGS. 1 to 3 of the accompanying drawings, a cantilevered swing jaw crushing apparatus 1 comprises a main frame 3 having a front 5, a back 7 and two side walls 9. The side walls 9 include liner plates 11, which can be replaced when they are worn out. A stationary jaw 13, also provided with a liner plate 11, is fixed to the main frame 3 by means of tension rods 15, as shown in FIG. 1.

A cantilevered swing jaw 17 comprises an upper portion 19, mounted about a pivot axis 21 to the main frame 3, and a lower portion 23. The lower portion 23 supports a liner plate 11 facing the stationary jaw 13. The region between the two liner plates 11 of the stationary jaw 13 and the swing jaw 17 is where rocks or other materials are crushed as the cantilevered swing jaw 17 moves relative to the stationary jaw 13. The swing jaw 17 is driven by a toggle drive system 25, which is well known in the art.

As the toggle drive system 25 operates, the swing jaw 17 oscillates at high speed about the pivot axis 21 to crush rocks or the like between the two jaws 13,17. The swing jaw 17 does not move far, perhaps up to two centimetres, but this is sufficient to crush rocks between the jaws.

As mentioned above, the swing jaw 17 is mounted on the main frame 3 about a pivot axis 21. More particularly, short stub axles 27 extend inwardly from either side of the main frame 3. The upper portions 19 of the swing jaw 17, which are relatively short and are attached to the sides of the lower portion 23 of the swing jaw 17, are mounted on these stub axles 27. Hence, as can be seen from FIGS. 2 and 3, the swing jaw 17 is partly T-shaped.

To avoid obstructing the feed opening of the crushing apparatus, the upper region of the apparatus, where the stub axles 27 are mounted, is widened so that the upper portions 19 of the swing jaw 17 are accommodated therein. This widened region of the main frame 3 can be provided with a chute liner (not shown) to guide material into the crushing apparatus.

In prior art crushing apparatus, it has been known to incorporate an impact plate to protect the upper regions of the swing jaw 17. Such an impact plate 29 is shown in the enclosed drawings. The present invention, however, aims to improve upon this arrangement by providing a bearing support 31 which contacts a portion of the swing jaw 17 throughout the motion of the swing jaw.

Figure 4:
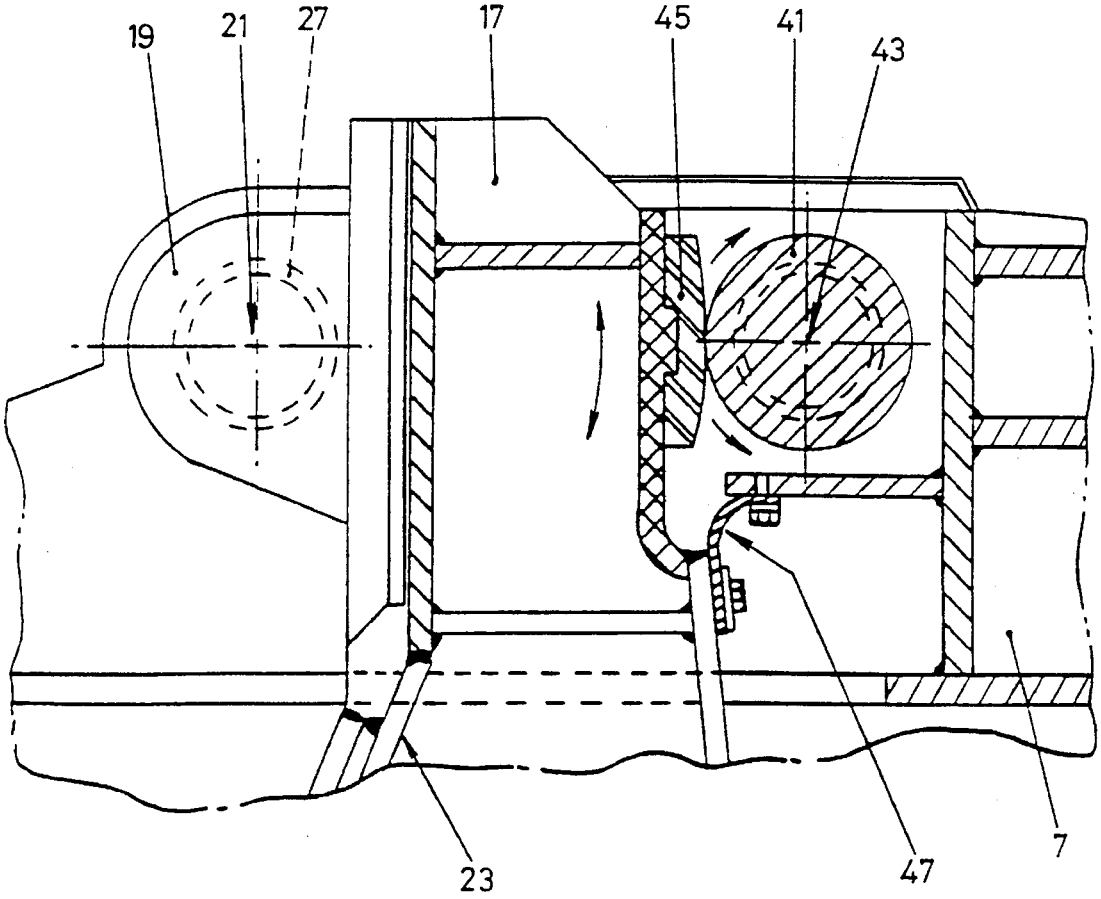
FIG. 4 is an enlarged sectional side view of a bearing support according to a second embodiment of the present invention.

The bearing support 31 shown in FIGS. 1–3 is in accordance with a first embodiment. FIG. 4 shows a second embodiment of bearing support.

With reference to FIGS. 1–3, the bearing support 31 includes a concave surface 33 which forms an arc about pivot axis 21. The surface 33 is self-lubricating to ensure smooth motion of the swing jaw 17 across the surface 33. In this regard, an elbow 35 is formed between the upper portion 19 and the lower portion 23 of the swing jaw 17, which elbow 35 has a curved surface which cooperates with the concave surface 33 of the bearing support 31. The concave surface 33 may be coated with polytetrafluoroethylene or, alternatively, it can be formed from nylon or some other appropriate material. A number of shims 37 are held between the concave surface 33 and the main frame 3, to which the bearing support 31 is attached by means of a bolt 39. By including the shims 37, undue wear between the concave surface 33 and the main frame 3 is avoided.

Another advantage of the present invention is that, by incorporating the bearing support 31, the length of the upper portion 19 of the swing jaw 17 can be made considerably shorter than in the prior art crushing apparatus. This helps to reduce further the forces acting on the pivot axis 21.

When rocks or the like are entered into the crushing apparatus 1, much of their momentum is dispersed by means of the impact plate 29. However, forces are still exerted on the jaws 13, 17 and the bearing support 31 ensures that these forces are directed to the main frame 3, rather than to the pivot axis 21. The life span of the crushing apparatus is thereby increased and the strength of the pivot axis 21 does not need to be made so strong. Hence, stub axles 27 can be used, rather than a complete pivot axle across the whole width of the crushing apparatus, as in many prior art apparatus. The feed opening of the apparatus is therefore larger than in most prior art apparatus.

In the second embodiment of the present invention, shown in FIG. 4 of the accompanying drawings, the fixed bearing support 31 of FIG. 1 is replaced by a steel roller 41, which can rotate about an axis 43. As the swing jaw 17 moves, a bearing surface 45 attached thereto causes the steel roller 41 to rotate.

Due to the roller 41 being securely mounted on the main frame 3 of the crushing apparatus 1, forces applied to the swing jaw 17 are once again directed essentially to the main frame 3, rather than to the pivot axis 21.

As can also be seen from FIG. 4, the roller 41 is enclosed by the main frame 3 and a flexible seal 47. [The concave surface 33 of the first embodiment is also preferably enclosed in a similar manner.] In this way, dust and debris cannot foul the contact between the roller 41 and the bearing surface 45. The flexible seal 47, however, enables the swing jaw 17 to move by the required amount.

It will of course be understood that the present invention has been described about purely by way of example, and that modifications of detail can be made within the scope of the invention as defined in the appended claims.

We claim:

1. A cantilevered swing jaw crushing apparatus (1) comprising a main frame (3), two jaws (13,17) mounted on the main frame (3) for crushing material passing through the apparatus (1) and means (25) for driving the jaws in a crushing action, wherein the cantilevered swing jaw (17) comprises an upper portion (19) pivotally attached to the main frame (3) and a lower portion (23) for cooperating with the second jaw (13) of the apparatus, the upper and lower portions (19,23) defining an elbow (35), characterised in that the cantilevered swing jaw (17) is mounted on the main frame (3) by means of two short stub axles (27) extending inwardly from the main frame (3), and in that a bearing support (31,41) is mounted on the main frame (3) and bears against the rear of the elbow (35) of the cantilevered swing jaw (17) to support the swing jaw (17) throughout the motion of the jaw such that at least some forces exerted on the swing jaw (17) are transferred to the main frame (3) rather than to the stub axles (27) mounting the swing jaw (17).

2. A crushing apparatus as claimed in claim 1, wherein the bearing support (31) includes an arcuate surface (33) which contacts the swing jaw (17) throughout the motion of the jaw.

3. A crushing apparatus as claimed in claim 2, wherein the arcuate surface (33) is self-lubricating.

4. A crushing apparatus as claimed in claim 2 wherein the arcuate surface (33) is polytetrafluoroethylene (PTFE) or nylon.

5. A crushing apparatus as claimed in claim 2, wherein the bearing support includes at least one shim between the arcuate surface and the main frame.

6. A crushing apparatus as claimed in claim 1, wherein the bearing support includes a roller (41), the surface of the roller contacting the swing jaw (17).

7. A crushing apparatus as claimed in claim 6, wherein a plurality of rollers (41) are spaced across the width of the crushing apparatus (1).

8. A crushing apparatus as claimed in claim 6, wherein the roller is made of steel.

9. A crushing apparatus as claimed in claim 1, wherein the bearing support is enclosed by the main frame, and further comprising at least one flexible seal attached to the swing jaw.

10. A crushing apparatus as claimed in claim 1, wherein the second jaw (13) is a stationary jaw fixed to the main frame (3).

11. A crushing apparatus as claimed in claim 1, wherein the main frame (3) widens adjacent the stub axles (27) so that the stub axles (27) do not obstruct a top feed opening of the crushing apparatus (1).

12. A crushing apparatus as claimed in any preceding claim, wherein the means for driving is a toggle drive system (25).

* * * * *